US012084225B2

(12) United States Patent
Roselaar et al.

(10) Patent No.: US 12,084,225 B2
(45) Date of Patent: Sep. 10, 2024

(54) EASY OPEN END WITH INCREASED PANEL STIFFNESS

(71) Applicant: CROWN PACKAGING TECHNOLOGY, INC., Alsip, IL (US)

(72) Inventors: Katherine Roselaar, Oxfordshire (GB); Elliann Amy Edwards, Oxfordshire (GB); Blanca Pascual Oliver, Oxfordshire (GB); Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 359 days.

(21) Appl. No.: 17/423,641

(22) PCT Filed: Jan. 17, 2020

(86) PCT No.: PCT/GB2020/050096
§ 371 (c)(1),
(2) Date: Jul. 16, 2021

(87) PCT Pub. No.: WO2020/152439
PCT Pub. Date: Jul. 30, 2020

(65) Prior Publication Data

US 2022/0089318 A1 Mar. 24, 2022

(30) Foreign Application Priority Data

Jan. 23, 2019 (GB) ..... 1900924

(51) Int. Cl.
*B65D 17/28* (2006.01)

(52) U.S. Cl.
CPC ..... *B65D 17/4011* (2018.01); *B65D 17/404* (2018.01); *B65D 2517/007* (2013.01); *B65D 2517/0074* (2013.01)

(58) Field of Classification Search
CPC ..... B65D 17/4011; B65D 17/404; B65D 2517/007; B65D 2517/0074
See application file for complete search history.

(56) References Cited

U.S. PATENT DOCUMENTS 3,441,171 A 4/1969 Stec
3,591,037 A 7/1971 Schrecker
(Continued)

FOREIGN PATENT DOCUMENTS

CN 2560573 Y 7/2003
CN 201124976 Y 10/2008
(Continued)

OTHER PUBLICATIONS

Translation of EP 0 256 920 provided by Espacenet. (Year: 2023).*

*Primary Examiner* — James N Smalley
(74) *Attorney, Agent, or Firm* — Condo Roccia Koptiw LLP

(57) ABSTRACT

A metal easy open can end adapted for closing a metal can body is proposed. The can end has a score (27) defining a removable panel (26) and a tab (23), located at an edge region of the panel, for applying a force to the panel to allow the panel to be removed in a tear direction. The panel (26) has at least one embossed and/or debossed rib (25 *a-c*) extending substantially in said tear direction from a location or locations proximal to said tab to a location or locations proximal to an end of the panel opposite to said edge region. The rib(s) have a depth or height of at least 0.6 mm relative to surrounding panel regions along at least a part of the rib extent.

30 Claims, 9 Drawing Sheets

(56) References Cited

U.S. PATENT DOCUMENTS

| | | | | | |
|---|---|---|---|---|---|
| 3,715,050 | A * | 2/1973 | Batchelar | B65D 17/4011 | D9/438 |
| 3,874,553 | A | 4/1975 | Schultz et al. | | |
| 4,690,297 | A * | 9/1987 | Hoft | B65D 17/4011 | 220/273 |
| 4,767,020 | A * | 8/1988 | Peter | B65D 17/4011 | 220/273 |
| 5,964,366 | A | 10/1999 | Hurst | | |
| 9,499,300 | B2 | 11/2016 | Deltour | | |
| 2008/0197132 | A1 * | 8/2008 | Hasegawa | B65D 17/4011 | 220/269 |

FOREIGN PATENT DOCUMENTS

| | | | |
|---|---|---|---|
| CN | 102574608 | A | 7/2012 |
| EP | 0061980 | A1 | 10/1982 |
| EP | 0256920 | A1 | 2/1988 |
| GB | 2562464 | A | 11/2018 |
| WO | 2008098761 | A1 | 8/2008 |
| WO | 2010133809 | A1 | 11/2010 |

* cited by examiner

EASY OPEN END WITH INCREASED PANEL STIFFNESS

CROSS-REFERENCE TO RELATED APPLICATIONS

This application is the National Stage of International Application No. PCT/GB2020/050096 filed Jan. 17, 2020 which claims the benefit of GB application number 1900924.0, filed Jan. 23, 2019, the disclosures of which are incorporated herein by reference in their entirety.

TECHNICAL FIELD

The present invention relates to an easy open end for a food or beverage can or the like, and which has an increased panel stiffness compared to conventional ends.

BACKGROUND

Food and beverage cans or containers conventionally have a two-piece or a three piece construction. A two-piece can comprises a can body with integral base formed by applying a drawing process to a metal disk or other shape. After filling, the open end of the can is closed by applying an end, and seaming the end to the can body. A three piece can comprises a cylindrical can body formed by rolling and welding along the seam. Ends are seamed to the can body to close both the top and bottom openings.

So-called easy open ends have been developed which avoid the need for a user to employ a can-opener to open a can. A typical easy open end has a centre region within which is defined a continuous score. The score in turn defines a panel that is removed on opening. A tab is secured to the panel with a rivet. The tab has a nose portion outside of the rivet and arranged to act on the panel at a location inside but proximal to a portion of the score. The tab further has a lift portion located inside of the rivet, into which a user can insert the tip of a finger. To open the end, a user first lifts the lift portion of the tab to cause an initial fracture of the score. The user typically then removes his or her finger and reinserts it into the opposite side of the lift portion and pulls the tab away from the end, causing the score to fracture along its remaining length until the panel can be completely removed.

FIG. 1 illustrates a conventional easy open end suitable for use with a can body of generally rectangular cross-section, where the continuous score is identified by reference numeral 1 and the tab by reference numeral 2. A countersink 3 separates a peripheral curl 4 from the region outside of the score. The score defines within it a panel 5 to which the tab 2 is secured by a rivet 6. Such can bodies are typically of the DRD (Drawn and Redrawn) type, although this need not be the case. Cans of this type are often used as containers for fish, meat, and the like. The end may be of aluminium, although steel ends are known.

The illustrated end has an outer terrace 7 which extends around the inside of the score 1, deviating to pass inside of the rivet 6. Within the outer terrace, a series of inner terraces 8*a-c* define three shallow panels 9*a-c*. The outer terrace 6 has a depth of approximately 0.4 mm from the base of the countersink, whilst the inner terraces 8*a-c* have a depth of approximately 0.4 mm from the outer terrace. The purpose of the panels 9*a-c* is to absorb excess material from the scoring process and make the end suitable for stacking and feeding into the seamer. The panels have a relatively shallow depth to allow bending on opening; such bending has in the past been thought to be desirable.

Opening involves the following stages:

1) Pop—The tab is rotated upwards, causing the nose to pierce the score and opening an arc near the front of the end.
2) Tear—The tab is pulled back by the user causing the score to tear along the sides of the panel.
3) Panel removal—The tab continues to be pulled backwards by the user and the panel detaches from the surrounding rim.

In stage 3), the panel removal occurs suddenly such that with a conventional end the panel tends to spring backwards and upwards towards the user's hand. This often causes liquid on the underside of the panel to be propelled away from the panel. Splashes of food (e.g. tomato sauce) are of course undesirable as they will contaminate the user's hand, clothing and the surrounding environment.

The reason that the panel springs back suddenly is that elastic energy is stored in the end during the tear operation. The amount of energy is related to the degree of deformation in the panel. For a conventional end such as that illustrated in FIG. 1, the minimum radius of curvature in the panel during opening may be 50 mm. This is illustrated in FIG. 2 which shows a panel after removal.

SUMMARY

According to a first aspect of the present invention there is provided a metal easy open can end adapted for closing a metal can body. The can end has a score defining a removable panel and a tab, located at an edge region of the panel, for applying a force to the panel to allow the panel to be removed in a tear direction. The panel has at least one embossed and/or debossed rib extending substantially in said tear direction from a location or locations proximal to said tab to a location or locations proximal to an end of the panel opposite to said edge region. The rib(s) have a depth or height of at least 0.6 mm relative to surrounding panel regions along at least a part of the rib extent.

The or each rib may extend in said tear direction across at least 50%, and preferably at least 70%, of said panel. Furthermore, the or each rib may extend in said tear direction across no more than 80% of said panel.

The or each rib may have a depth or height of at least 0.8 mm relative to the surrounding panel regions.

The height or depth of the or each rib relative to the surrounding panel regions may be substantially constant along its extent.

Alternatively, the height or depth of the or each rib relative to surrounding panel regions may taper from a minimum height or depth at the ends proximal to the tab to a maximum height or depth part way along its extents. The tapering may extend across 50% or less of the total extent of the or each rib.

Alternatively, the height or depth of the or each rib relative to surrounding panel regions may taper from a minimum height or depth at the end proximal to the tab to a maximum height or depth at a distal end. The tapering may extend across 90% or more of the total extent of the or each rib. The tapering may be linear.

The or each rib may be configured to result in a radius of curvature of the panel, once removed, of greater than 150 mm, preferably greater than 200 mm.

The or each rib may have a substantially flat centre region, that region having an extent of at least 20% of the extent of said panel in a direction perpendicular to said tear direction.

Further, a rib region containing the or each rib may be substantially symmetrical about an axis extending substantially along the centre of the panel in said tear direction.

Alternatively, a rib region containing the or each rib may be substantially asymmetrical about an axis extending substantially along the centre of the panel in said tear direction.

The can end may comprise a peripheral curl and a countersink inside of the curl, said surrounding panel regions being substantially at the same height as a region of the can end immediately inside the countersink. In this case, the or each rib may be an embossed rib.

Alternatively, the can end may comprise a peripheral curl and a countersink inside of the curl, the can end further comprising a terracing feature inside of said score to provide a panel region inside the terracing feature that is at least 0.6 mm lower than a surrounding region. The top of the terracing feature may be no more than 5 mm away from said score. The or each rib may also be a debossed rib provided within said panel region.

The number of ribs may be three or more. Alternatively the number of ribs may be two.

In the case that there are a plurality of ribs, the ribs may be fully discrete.

Alternatively, the ribs may merge at one or both of their end regions and/or merge at regions part way along their extents, with respect to the tear direction.

Further embossed or debossed ribs may be provided, extending between said first mentioned ribs in a direction substantially perpendicular to said tear direction. The height or depth of said further ribs may be less than the height or depth of the first mentioned ribs.

The score residual of the said score may be substantially 0.10 mm along all or a majority of its extent.

Said score may have an increased score residual at one or both of a region proximal to a nose of said tab and a region that is a final region to be fractured during panel removal. In this case, said increased score residual may have a score residual that is in the region of 0.02 mm greater than the score residual of the remainder of the score.

A method of manufacturing a can and according to any of the above disclosure is also provided, the method comprising forming the embossed or debossed rib(s) prior to forming said score.

DETAILED DESCRIPTION

In order to reduce the risk of liquid and material splashing upon opening of an easy open can end, it is recognised here that it is desirable to increase the panel stiffness of the end at least in that region of the end close to the final tear portion of the score. This may be achieved by providing a heavily embossed or debossed panel resulting in reduced energy storage during opening and reduced vibration when the panel is released. This is applicable in particular, though not necessarily, to irregularly shaped, i.e. non-circular, aluminium ends; irregular ends are more susceptible to splashing as the panel is relatively long compared to its width giving rise to a structure with a much lowed axial stiffness in comparison with round ends. The embossing or debossing may be in the form of a plurality of deeply embossed or debossed ribs that extend across the majority of the removable panel from the tab end to the opposed end that is the final region of the panel to be removed. Whilst easy open ends with ribs formed in the panels are known, these ribs are relatively shallow and are designed to allow the panel to bend during opening. The ribs may be substantially flat over their centre regions.

The benefits of an approach that utilises relatively deep ribs may include:

- The tear stage of the opening operation occurs in a single smooth step making this stage more controllable for the user.
- Energy storage in the panel during opening is reduced as compared to a conventional end, making the end easier to open for the user.
- Reduction of energy stored in the end panel during opening reduces the effect of the panel oscillating as it is removed from the rim, thus reducing splashing and improving cleanliness.
- The approach may be relatively straightforward to introduce to existing manufacturing and filling lines whilst maintaining existing line speeds.

Figure 1:
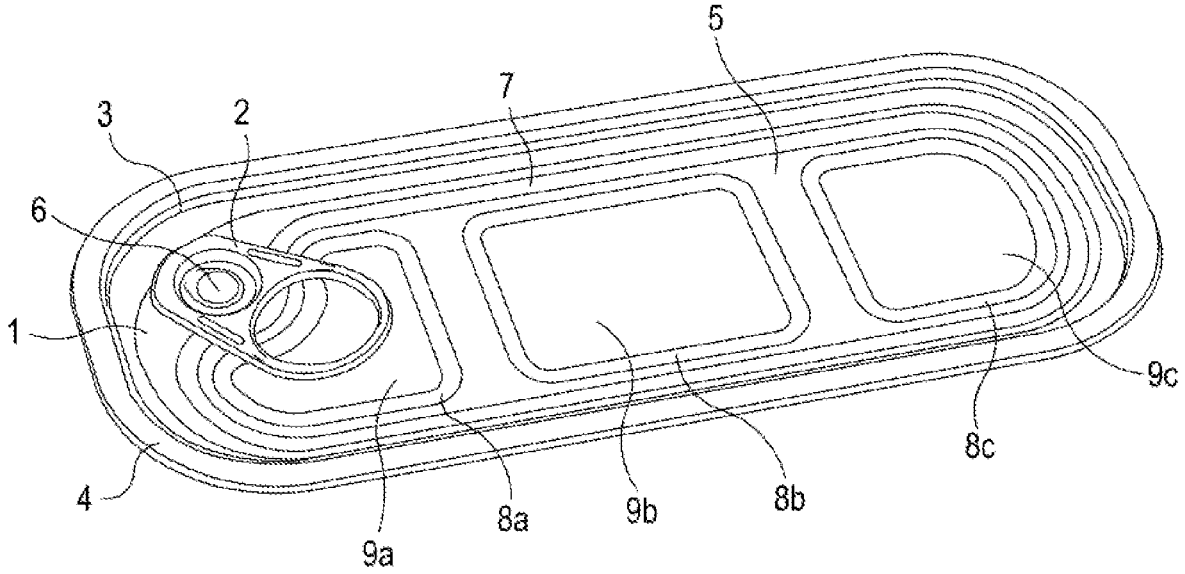
FIGS. 1 and 2 show an easy open can end of the art prior to and after removal, respectively.
Figure 3:
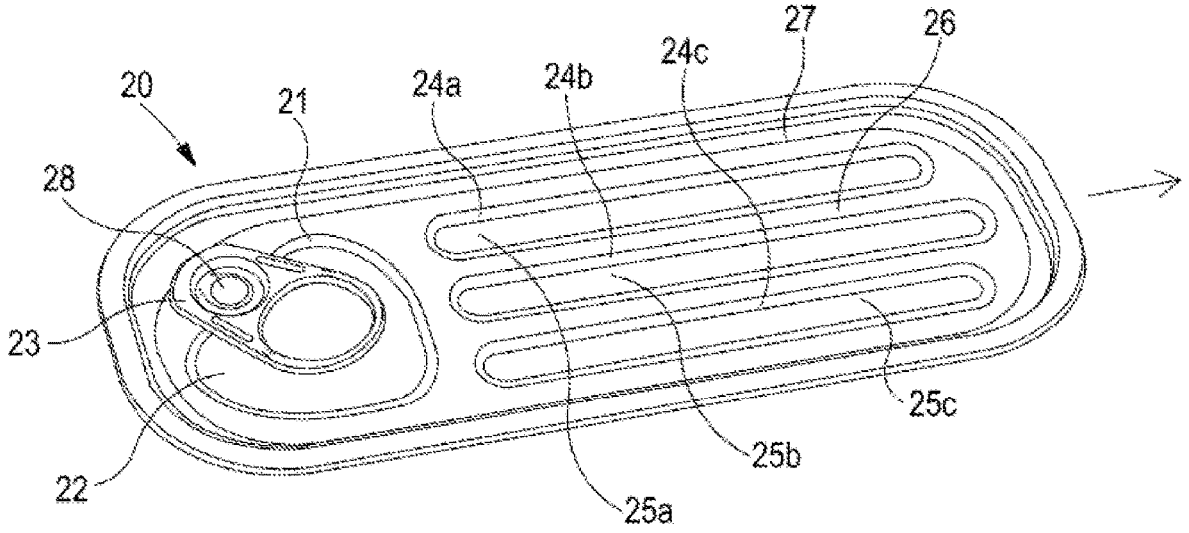
FIG. 3 illustrates an easy open end of the present invention, having 3 debossed ribs.

FIG. 3 illustrates schematically an easy open end 20 of similar overall dimensions to that of the conventional end shown in FIG. 1, but which replaces the outer and inner terraces of that design with a first terrace 21 defining a finger access recess or panel 22 under a lift portion of the tab 23 (which is secured to the end by a rivet 28), similar to the finger access feature of the conventional ends, and three further terraces 24*a-c* which define respective recessed (debossed) ribs 25*a-c*. These ribs extend parallel to one another, in a direction that is aligned substantially with the tear direction of the panel 26 defined by the score 27. In the orientation shown in FIG. 3, this direction is generally from left to right (as indicated in the figure by an arrow). It is noted that the end comprises a peripheral curl, with a countersink immediately inside of the curl.

Figure 4:
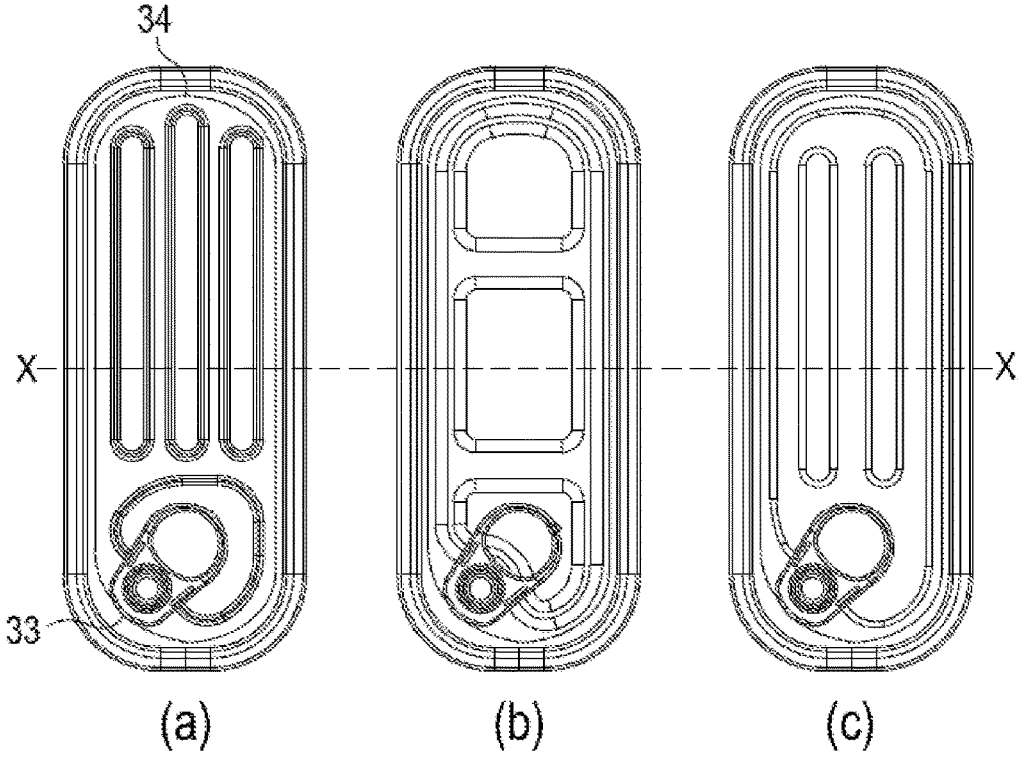
FIGS. 4 and 5 show plan and cross sectional views respectively, of a three rib design (a), the prior art (b) and a two rib design (c)
Figure 5A:
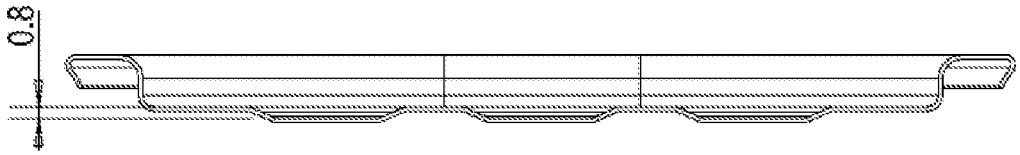
Figure 5B:
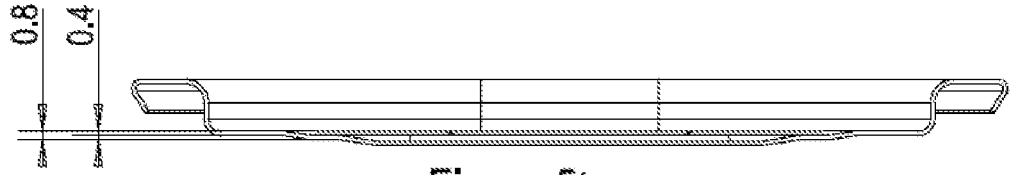
Figure 5C:
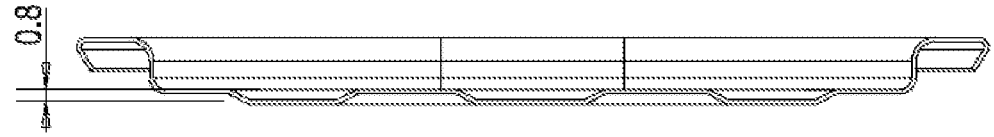

To accommodate the curved rightmost region of the score 27, the centre rib 25*b* is slightly longer at that end than the two other ribs 25*a*,25*c*. The ribs extend over at least 50% of the length of the panel 26, preferably in the region of 60% or more. The width of each rib is preferably at least 20% of the width of the panel 26. FIG. 4(*a*) shows a plan view of the top of the end 20, whilst FIG. 5(*a*) shows a transverse cross-sectional view of the end taken along the line XX of FIG. 4(*a*). As shown in FIG. 5(*a*), the depth of the debossed ribs is 0.8 mm. By way of comparison, FIGS. 4(*b*) and 5(*b*) show corresponding plan and cross-sectional views of the conventional end of FIG. 1. Whilst the embodiment of FIG. 3 provides for three ribs, the number of ribs can be varied to suit a range of end formats. For example an end with wide aspect ratio may require more ribs (i.e. more than three).

Figure 2:
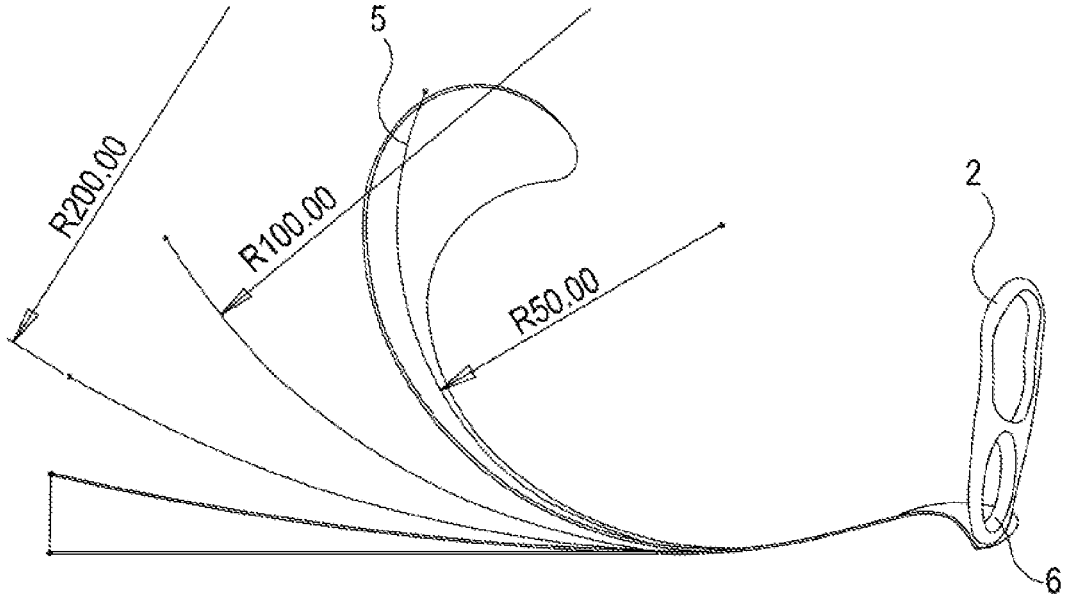

It has been found in practice that, for a 163.6×65.5 mm aluminium end constructed according to the design of FIG. 3 (with the following properties; H46 temper, 3014 series, 0.25 mm gauge), during opening the panel stiffness is such that the bend in the tear portion of the panel has a radius of curvature in the region of 450 mm (or at least greater than around 200 mm) as compared to around 50 mm for a conventional end (FIGS. 1 and 2). Such a panel is suitable, by way of example, for use with a shallow drawn can for fish products. The removed panel is shown in FIG. 6.

Figure 6:
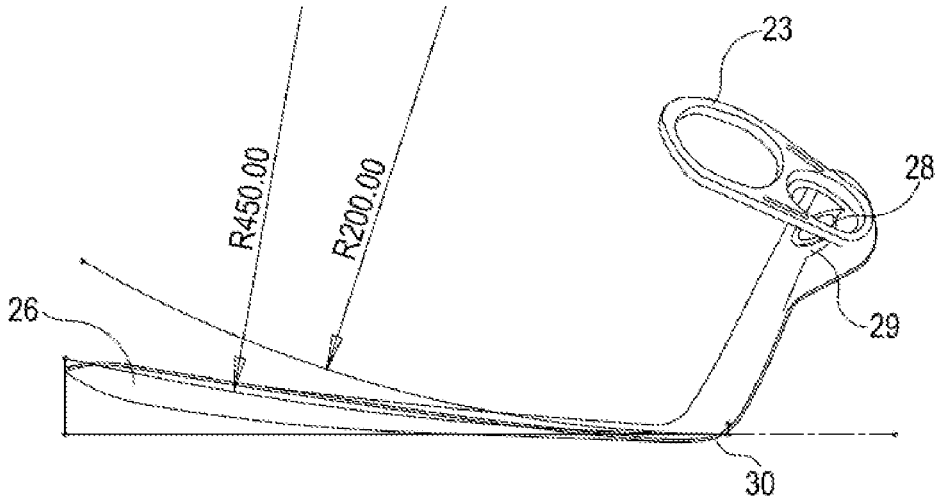
FIG. 6 shows a panel of the present invention, prior to removal.

It will be observed from FIG. 6 that the panel is intentionally designed to fold in two places during opening. Firstly, the panel 26 folds inwards at the rivet 28 about a first axis 29 when the panel completes the 'pop' opening event and, secondly, it folds outwardly about a second axis 30, just ahead of the region in the panel 26 that is stiffened by the ribs 25*a* to 25*c*.

It is important that the initial tear of the panel is not too sudden in order to avoid a high peak tear force. A peak tear force of around 40 N may for example be acceptable.

It has been determined that the stiffness of the panel is approximately equal to the square of the rib depth. Thus doubling the rib depth from 0.4 mm to 0.8 mm gives a stiffness increase of approximately four times. As metal usage is a key factor in the production costs of ends, it might be assumed that it is more metal efficient to have fewer but deeper ribs. However this situation is complicated by several factors.

It is found that with fewer ribs, the panel tends to bend across its width so stiffness is lost, the shape resembling a hyperbolic paraboloid (viewed in cross-section across the shorter, width of the panel). It is also significantly more difficult to form deep ribs, and the process may lead to material stretching and/or coating damage.

A drawing operation to form deep ribs may give rise to warping of the end due to stresses that are induced. Warping is the effect of the residual stresses pulling the end into a non-flat shape such that it becomes very difficult to stack, or feed from a stack at high speed.

Taking all of this into account, the inventors have concluded that the best manufacturing approach is to form the deep ribs before scoring, and then to complete the process with a final forming operation after scoring to remove the slack material and create a flat component that is suitable for stacking and feeding.

For a can end, the score residual thickness is the thickness of metal remaining under the score. Score residual thickness is of course a key parameter in determining the ease of opening of an end. The usual effect of a reduced score residual (i.e. a deeper score) is to reduce the initial tear force required to open an end. A reduction in tear force likely results in reduced stored energy during opening (reducing the risk of splashing) whilst reducing the risk of the panel folding unintentionally during opening. Tests have shown that reducing the score residual thickness, from the standard 0.12 mm down to 0.10 mm, gives rise to a small reduction in the tear force required to open an end. Combining the deeply embossed or debossed panel with a lower score residual thickness increases the required opening force slightly at the start of the panel tear as compared to a conventional end of comparable dimensions.

Figure 7A:
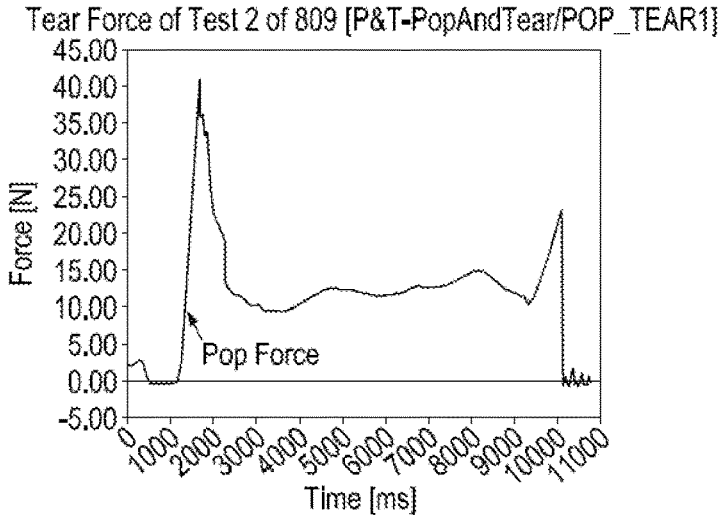
FIG. 7 displays three graphs illustrating the force required to remove a panel of the prior art (a), a panel of the prior art with a reduced score residual (b), and a panel of the present invention with a reduced score residual (c)
Figure 7B:
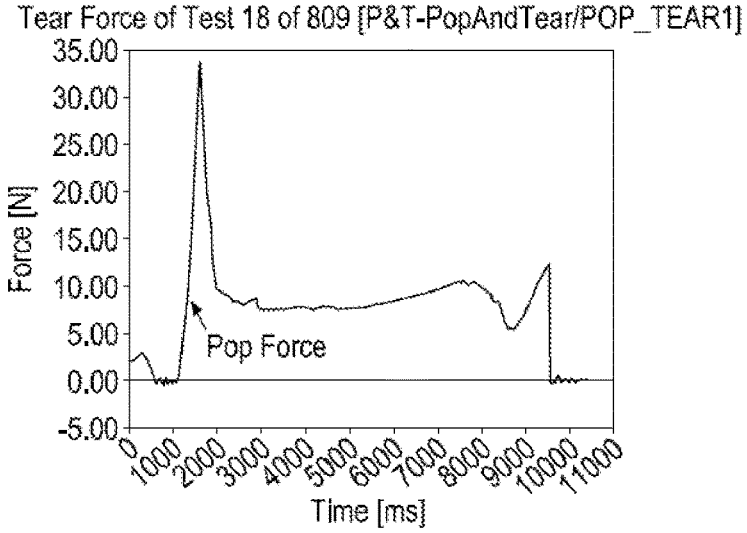
Figure 7C:
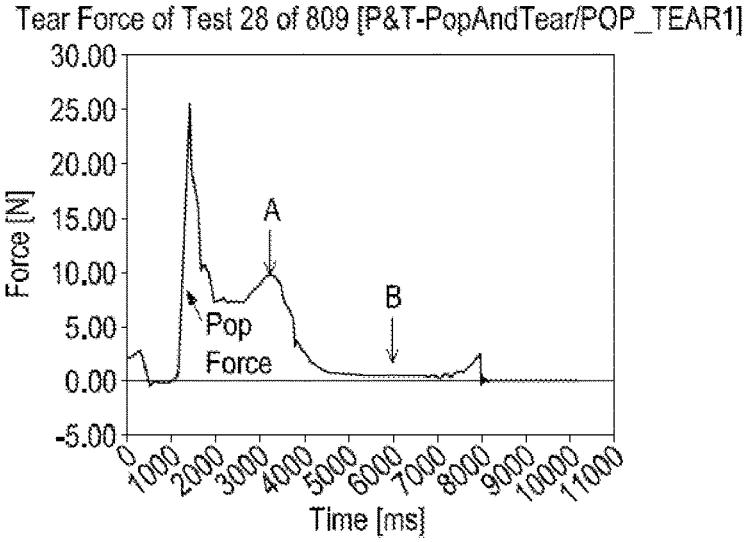

FIG. 7 illustrates the results achieved using the industry standard "Pop and tear Tester" measurement device, where the x-axis represents time and the y-axis represents "user" applied force. Chart (a) represents the conventional end geometry (FIG. 1) and score residual (0.12 mm), chart (b) represents the conventional end geometry (FIG. 1) and reduced score residual (0.10 mm), and chart (c) represents the deeply debossed end geometry (FIG. 3) and reduced score residual (0.10 mm).

Referring to chart (c), region A indicates the above noted small rise in the force required to open the panel at the start of the tear. Region B though points to a significant reduction in tear force for the remainder of the panel tear. As the overall energy stored in the panel during opening is proportional to the area under the curves, it can be seen that the energy stored in the improved design (new geometry and reduced score residual) may be reduced by over 50% in comparison with a standard end.

Figure 8:
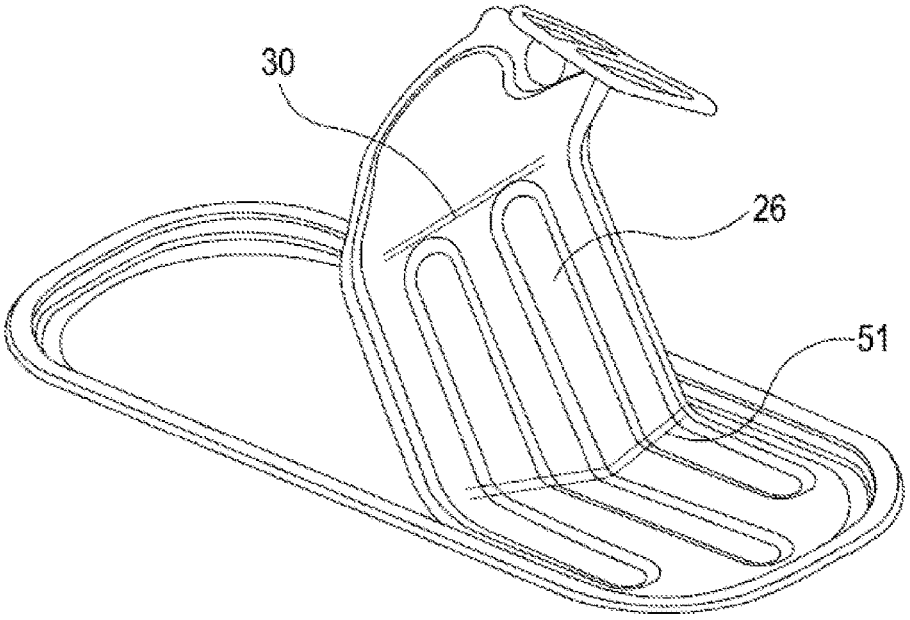
FIG. 8 illustrates a panel which has failed during panel removal.
Figure 9A:
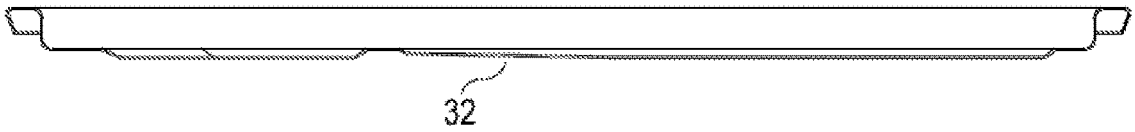
FIGS. 9*a* to 9*d* illustrate panels with tapering rib depth.
Figure 9B:
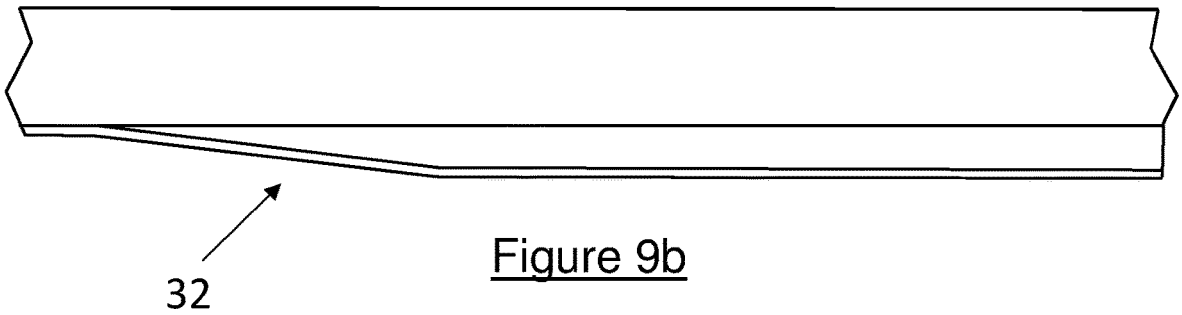
Figure 9C:
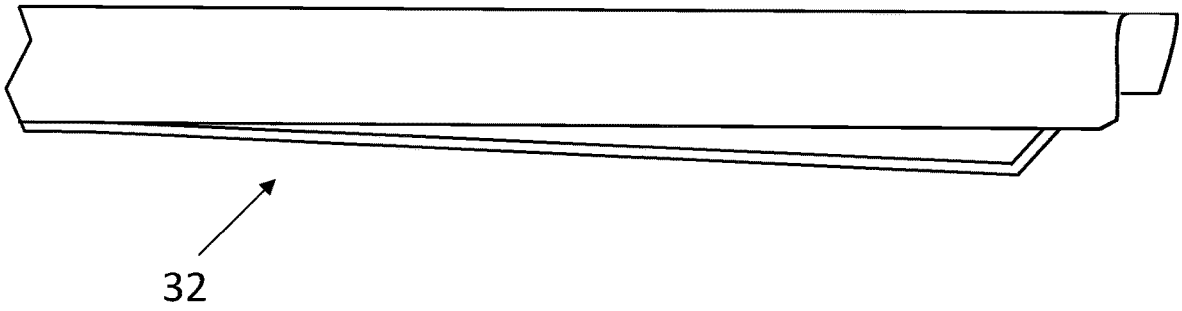
Figure 9D:
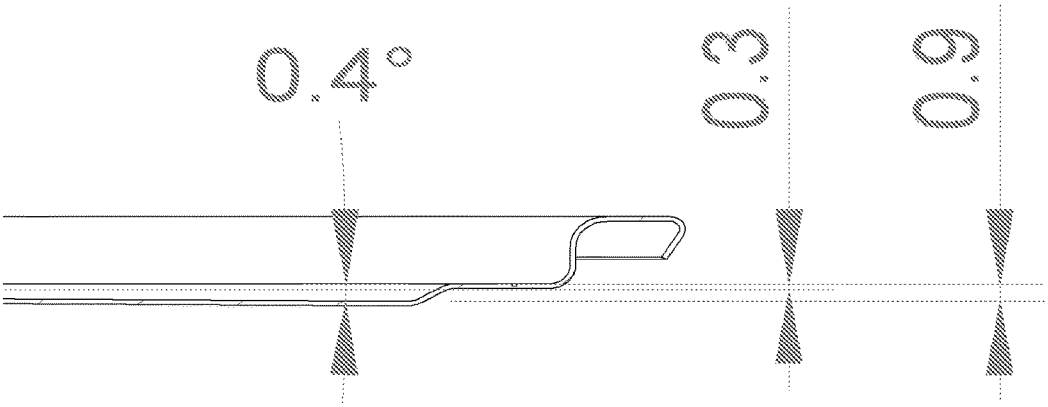
Figure 9E:
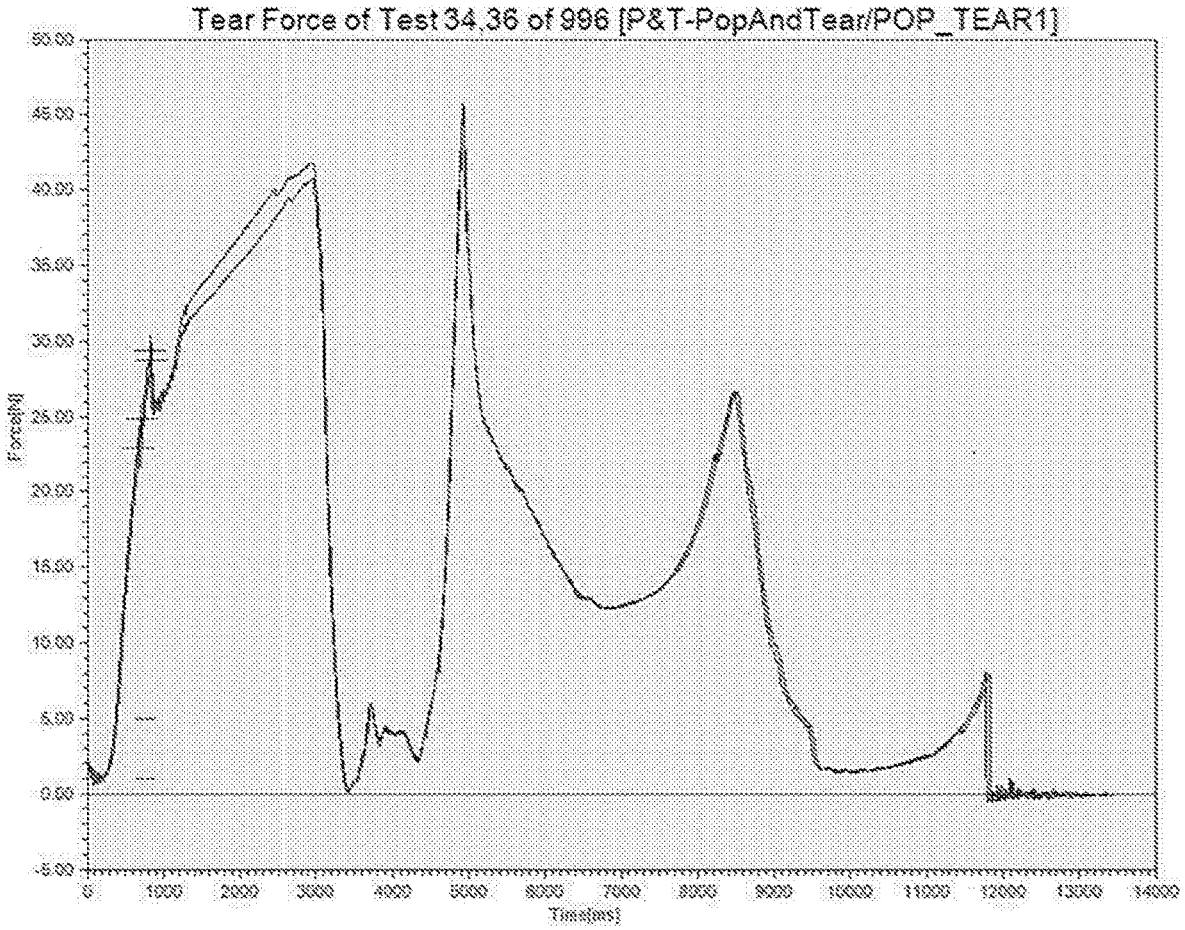
FIG. 9*e* displays a graph illustrating the force required to remove the panel of FIG. 9*c;*

It has been determined that panels with the improved design, but with a rib depth of less than 0.8 mm, may fail as a result of a fold occurring during opening. Such a failure is illustrated in FIG. 8 which shows a three rib panel folding along a third axis 31 towards the centre of the ribs (in a longitudinal sense). Even at a depth of 0.8 mm there may still be a tendency for the panel to fold in one or more places within the space occupied by the ribs. Counter-intuitively, it has been discerned that this folding is likely to be due to an excessive panel stiffness causing the end opening event to be very sudden, placing high forces into the panel. This will result in a much greater final opening force than illustrated, for example, in FIG. 7*c*.

This problem may be mitigated by incorporating a tapered region at the start of each of the ribs (although possibly not for all of the ribs). For example, a tapered region may involve starting at 50% depth (i.e. 0.4 mm) at the end of the ribs proximal to the tab, tapering linearly down to the full depth (i.e. 0.8 mm) by the point where the ribs reach 30% of the panel length (34 mm). Indeed, with test samples produced with such a taper it was found that the panels did not fold during opening. It is thought that the taper works by giving slight panel flexibility at the start of the rib so that the peak tear force is reduced. FIG. 9 (*a*) is a longitudinal cross-sectional view of a panel with tapering rib depth, where the tapered region is indicated by reference numeral 32;

FIG. 9 (*b*) shows an enlarged view of the rib with the tapered region 32 at the start, the remainder of the rib having a constant depth.

Alternatively, the taper may extend along substantially the entire rib length. FIG. 9 (*c*) is a partial longitudinal cross-section of a panel comprising one or more such ribs (NB the taper here is not shown to scale). In this example, the depth of the or each rib increases linearly from a shallow end proximal to the tab to a maximum depth at a distal end. The taper may extend over at least 90% and preferably over substantially 100% of the length of each rib.

FIG. 9 (*d*) is a partial longitudinal cross-section of the panel of FIG. 9 (*c*), with tapering rib depth over substantially the entire rib length. In this example, the depth of the or each rib increases linearly over its entire length to a maximum depth of around 0.9 mm at its distal (deepest) extent. Here, the taper has an angle of 0.4 degrees, whilst the metal thickness is 0.3 mm.

In alternative examples, not shown here, a panel may comprise a combination of one or more embossed or debossed ribs which are tapered along at least a part of their length, and one or more embossed or debossed ribs which are of constant depth.

FIG. 9 (*e*) illustrates test results for the panel shown in FIG. 9 (*c*) (i.e. having ribs linearly tapered over substantially the entire rib length) achieved using the "Pop and tear Tester" measurement device, where the x-axis represents time and the y-axis represents "user" applied force. Whilst the final opening force of the lid is greater than that achieved with a non-tapering ribs (see FIG. 7*c*), the risk of folding during opening is reduced.

Considering further the reduction in score residual proposed above (e.g. from 0.12 to 0.1 mm), a problem that might arise is that the end may open accidentally during handling, e.g. on a filling line or during subsequent distribution. In particular, an end may open due to impact on the top of the tab which can cause the score to rupture at this point. A possible solution is to combine the lower score residual (0.1 mm) in the tear region with a standard residual (0.12 mm) at the portion of the score near the nose of the tab. Reference number 33 in FIG. 4(*a*) points to the position of such an increased score residual.

A further improvement that can be combined with all previous embodiments involves adding an "arrester" at the end of the score profile, i.e. in the final tear region. 'Arrester flat' technology has been used for several years on conventional easy open ends. A typical manufacturing approach with conventional ends is to grind a flat on the score tool at the tool position that engages a rear portion of the score, resulting in an increase in the residual such that the panel is more difficult to detach from the end. During opening, the user peels open the panel to the point of the arrester. They then find that the force to completely remove the panel is very high. At this point they stop the pulling motion and are required to rock the panel backwards and forwards. This causes the arrester to break by fatigue failure and the panel to detach. However, in practice, some users have not learnt this 'rocking' technique and simply pull very hard to release the panel. This has the effect of releasing a lot of stored energy when the panel suddenly detaches.

For the debossed rib design described above, the purpose of the arrester is different. During the panel tear operation the opening force is relatively low, potentially allowing the final detachment to occur very quickly. An arrester can be used to prevent this, but without increasing the force above that in a conventional end (one that does not have an arrester). For example, where the residual in the tear region is reduced to 0.10 mm, the provision of an arrester may increase the residual to 0.12 mm at the rear of the panel. Thus the residual at the rear is the same value as for a conventional end (0.12 mm) meaning that the final detachment force is substantially unchanged over the conventional end. Reference numeral 34 in FIG. 4(*a*) points to a region in which the arrester is provided.

Forming techniques are known to allow ribs to be formed into an end at high speeds. For example, a suitable process might comprise:

Blank and draw operation to form the shell with countersink.

Bubble and button stages to form a raised pedestal.

Scoring operation to reduce the residual along the opening path.

Panel forming to profile the panel and remove slack material created in the scoring process Staking of the tab onto a pedestal Additional steps may of course be involved depending on the complexity of the panel form, for example pre-forming features into the panel prior to the scoring process.

Figure 10:
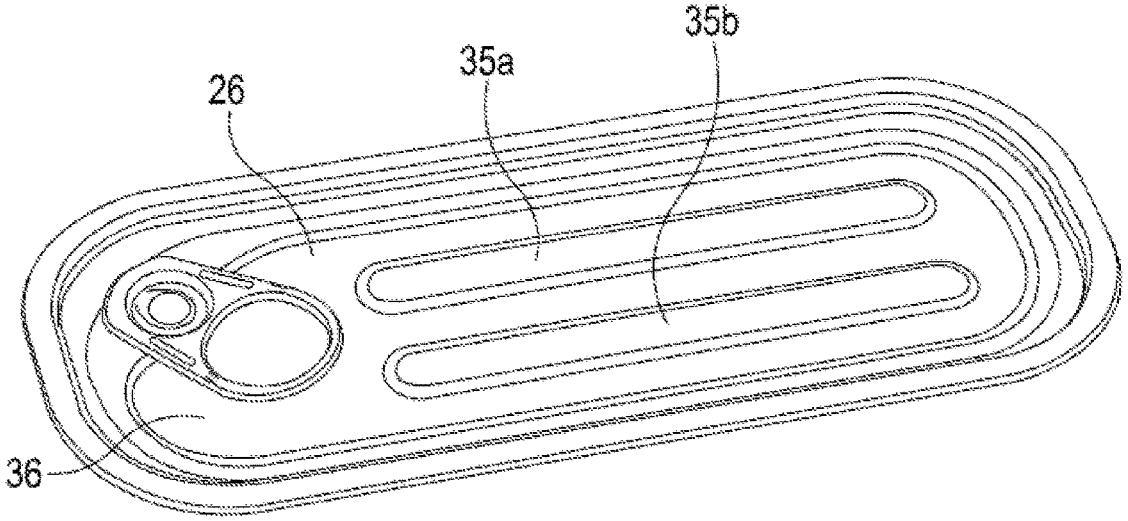
FIG. 10 illustrates an easy open end of the present invention, having 2 debossed ribs.

The ribbed structure can be formed by depressions (e.g. the three rib design of FIG. 3) or by depressing the full panel tool and embossing the ribs. This latter embodiment is illustrated in perspective view in FIG. 10, the corresponding plan view of FIG. 4(*c*), and the cross-sectional view of FIG. 5(*c*), and employs two embossed ribs 35*a*,35*b* formed in a debossed area 36 of the panel 26. The stiffness in the region of the ribs can be similar for both design approaches.

Figure 11:
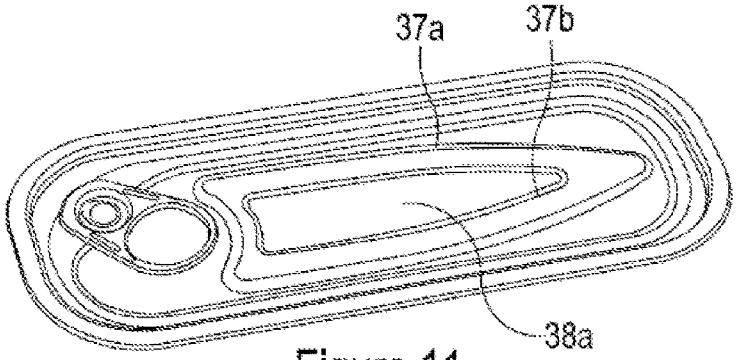
FIGS. 11 and 12 show embodiments having a pair of connected ribs in a 'shield' design.
Figure 12:
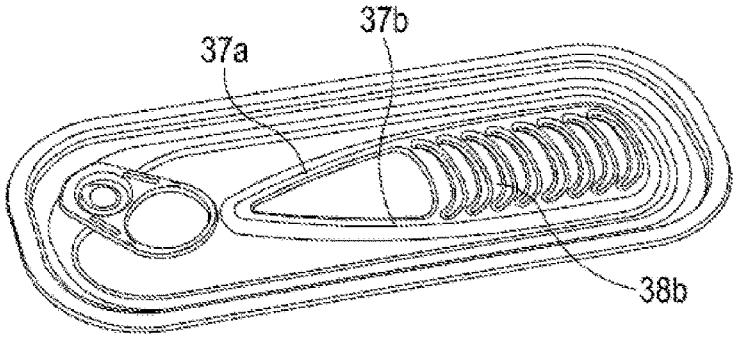

As discussed above, it is possible to achieve a higher stiffness with a deeper feature, but this has the disadvantage that some of the stiffness can be lost due to the panel bending across its width during opening. A possible solution to this problem involves adding secondary lateral stiffening features within the longitudinal features (ribs). FIG. 11 illustrates an embodiment in which a pair of embossed ribs 37*a*,37*b* are joined at both ends such that the debossed feature has the shape of a shield. In this case, the indented inner panel 38*a* will add lateral stiffness to the panel. FIG. 12 presents a similar debossed design but with the shield rotated by 180 degrees. In this case, secondary debossed features 38*b* are provided in the form of lateral ribs extending between the two longitudinal ribs. The lateral ribs 38*b* have a depth of 0.5 mm which is 50% of the depth of the primary stiffening feature, i.e. 1.0 mm. The stiffening features may also have a tapered or curved (non-linear) profile in plan view.

Figure 13:
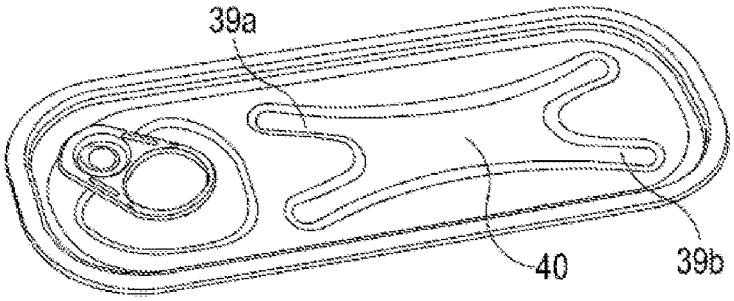
FIG. 13 illustrates an embodiment having a generally cross-shaped embossed design.

FIG. 13 illustrates a further embodiment having a generally cross-shaped embossed design which comprises a pair of embossed ribs 39*a*,39*b* which taper inwardly, at both sides, towards the centre of the panel from the start (proximal to the tab) to a minimum width and then tapers back outwardly to the final tear end of the panel. As such, the ribs 39*a*,39*b* merge in the centre region of the panel to form a common embossed region 40. A possible benefit of this structure is that it provides some lateral stiffness to the panel.

Figure 14:
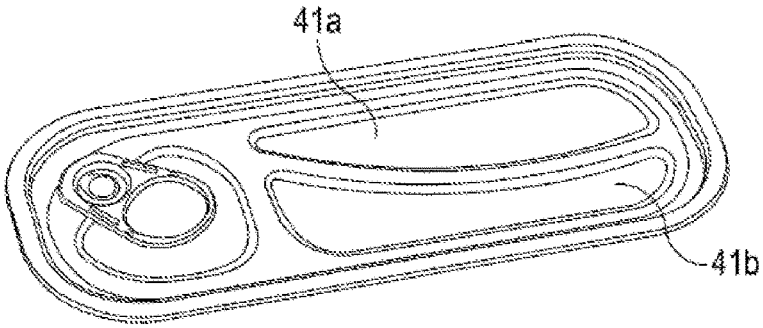
FIG. 14 illustrates an embodiment having an asymmetric design.

The stiffening features need not be symmetrical along the longitudinal axis (corresponding to the tear direction). An embodiment using non-symmetrical debossed features is shown in FIG. 14 and provides a pair of embossed asymmetrical ribs 41*a*,41*b*. Each rib has a generally straight, outermost side extending longitudinally along the panel, whilst the innermost sides of the ribs are curved, one being convex and the other being concave. A benefit of this design may be that it provides a non-symmetrical stiffness to the panel. Irregular easy open ends typically have two positions for the tab, either in a corner or on the middle of the smaller side of the panel. [Studies have suggested that the corner opening position is preferred by consumers, although both formats are widely used.] For the corner opening position, the panel tears asymmetrically starting at 45 degrees and rotating progressively to be closer to 90 degrees during the tear. An asymmetric panel profile can assist with this opening process by causing the panel to flex naturally towards the 90 degree position. To create this effect the stiffness of the panel is designed to be less on the side of the end where the tab is provided; thus the bend radius on this side of the panel is also tighter.

Figure 15:
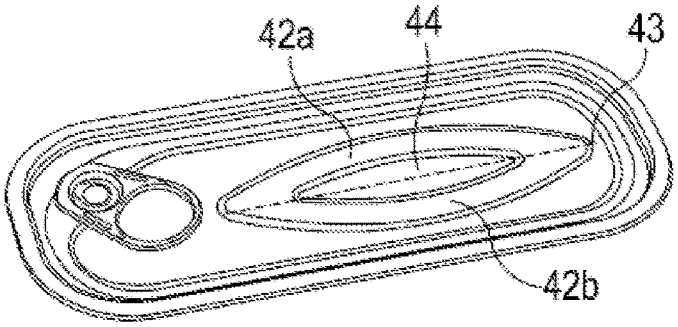
FIG. 15 illustrates an embodiment having a pair of connected ribs in a 'diamond-rib' design.

FIG. 15 illustrates a further embodiment, comprising embossed ribs 42*a*,42*b* connected at both ends, with the shape of the embossed ribs having line of symmetry 43 through the centre of the ribs along the longitudinal axis. This also provides a recessed central region 44, which increases the lateral stiffness of the panel. Alternatively, the design may comprise a pair of debossed ribs, connected at both ends, with a raised central region.

Figure 16:
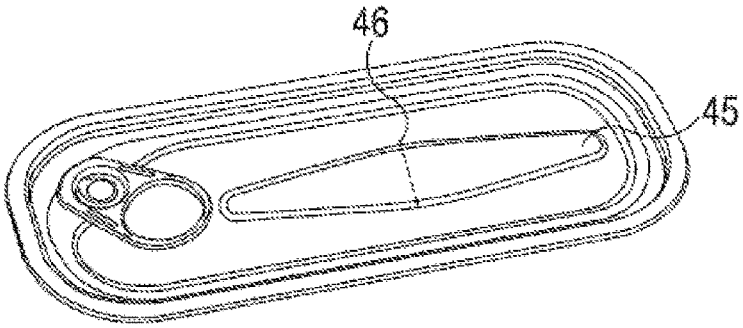
FIG. 16 illustrates an embodiment having a single 'diamond' rib.

FIG. 16 illustrates an embodiment which differs from the previously described embodiments in that the rib design is a single diamond shaped rib 45. This single 'diamond' rib 45 extends away from the tab in the tear direction, the diamond rib 45 increasing in width along the length of the rib until the mid-point of the length of the diamond rib, at which point the width decreases until the end of the rib proximal to the end of the panel. The diamond rib 45 may be an embossed or debossed rib. As shown in the figure, the diamond rib 45 may be symmetric about a line 46 running through the mid-point of the rib, perpendicular to the tear direction. Alternatively the rib may be asymmetric about the line 46, i.e. the width of the rib may not increase, from the tab-end to the mid-point, at the same rate as the width of the rib decreases from the mid-point until the end of the rib proximal to the end of the panel. The width of the rib 45 may increase/decrease by a factor of 2 along its length, and the width of the rib 45 at its widest point may be around 30% of the width of the panel.

Figure 17:
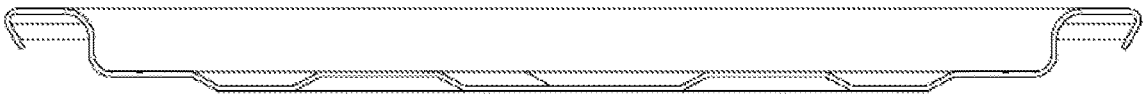
FIGS. 17 and 18 are side views of the embodiments of FIGS. 15 and 16 respectively.
Figure 18:
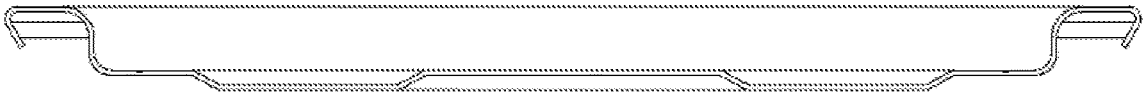

FIGS. 17 and 18 are side views of the embodiments of FIGS. 15 and 16 respectively. Sections through the centreline of the stiffening features show that there is approximately the same chord length of material on the top and bottom surfaces of the ribs—in the panel region of the end. This maximises the distance from the neutral axis and the corresponding panel stiffness.

Typical irregular end sizes vary from around 50 mm on the shortest side to around 150 mm on the longest side. However, the design features proposed here are suitable for all irregular end sizes, both for rectangular ends with rounded corners, oval ends and other more specialised footprints.

The regions between the debossed ribs, or the top of the debossed ribs, may be formed such that they lie in the same plane as the base of the countersink 3. This feature assists in both the manufacturing process, as well as facilitating stacking of the ends.

The design features may also be applied to steel easy open ends, with the benefit again being a reduction in overall stored energy during opening, making the end easier to open and improving cleanliness. Due to steel ends typically having a higher opening force than aluminium however, steel ends may be more sensitive to a change in the peak tear force. For steel ends therefore, the embossed or debossed rib design is preferably used in combination with the variable score residual design described above. This may allow the noted benefits to be obtained without increasing the tear forces significantly above those found in conventional irregular steel easy open ends.

The invention claimed is:

1. A metal easy open can end adapted for closing a metal can body, the can end having a score defining a removable panel and a tab, located at an edge region of the panel, for applying a force to the panel to allow the panel to be removed in a tear direction defined from a first end proximate the tab to a second end opposite the tab, the panel having at least one embossed or debossed rib extending substantially in said tear direction, the at least one rib having a maximum depth or height of at least 0.6 mm relative to surrounding panel regions along at least a part of the rib extent, wherein the at least one rib has a longitudinal taper such that a minimum rib height or depth is at the end of the at least one rib proximate to the tab and wherein the end of the at least one rib proximate the first end is spaced apart from the edge region of the panel.

2. The can end according to claim 1, wherein the at least one rib extends in said tear direction across at least 50%, preferably at least 70%, of said panel.

3. The can end according to claim 1, wherein the at least one rib extends in said tear direction across no more than 80% of said panel.

4. The can end according to claim 1, wherein the at least one rib has a depth or height of at least 0.8 mm relative to surrounding panel regions.

5. The can end according to claim 1, wherein the tapering extends across 50% or less of the total extent of the at least one rib.

6. The can end according to claim 1, wherein the height or depth of the at least one rib relative to surrounding panel regions tapers from a minimum height or depth at the ends proximal to the tab to a maximum height or depth at a distal end.

7. The can end according to claim 6, wherein the tapering extends across 90% or more of the total extent of the at least one rib.

8. The can end according to claim 6, wherein the taper is substantially linear.

9. The can end according to claim 1, the at least one rib being configured to result in a radius of curvature of the panel, once removed, of greater than 150 mm, preferably greater than 200 mm.

10. The can end according to claim 1, wherein the at least one rib has a substantially flat centre region, that region having an extent of at least 20% of the extent of said panel in a direction perpendicular to said tear direction.

11. The can end according to claim 1, wherein a rib region containing the or at least one is substantially symmetrical about an axis extending substantially along the centre of the panel in said tear direction.

12. The can end according to claim 1, wherein a rib region containing the at least one rib is substantially asymmetrical about an axis extending substantially along the centre of the panel in said tear direction.

13. The can end according to claim 1 and comprising a peripheral curl and a countersink inside of the curl, said surrounding panel regions being substantially at the same height as a region of the can end immediately inside the countersink.

14. The can end according to claim 13, wherein the at least one rib is an embossed rib.

15. The can end according to claim 1 and comprising a peripheral curl and a countersink inside of the curl, the can end further comprising a terracing feature inside of said score to provide a panel region inside the terracing feature that is at least 0.6 mm lower than a surrounding region.

16. The can end according to claim 15, wherein a top of the terracing feature is no more than 5 mm away from said score.

17. The can end according to claim 15, wherein the at least one rib is a debossed rib provided within said panel region.

18. The can end according to claim 1 wherein the at least one rib is a single rib, wherein a width of the rib in a direction perpendicular to the tear direction changes along the length of the rib in the tear direction.

19. The can end according to claim 1 wherein the at least one rib comprises three or more ribs.

20. The can end according to claim 1 wherein the at least one rib is two ribs.

21. The can end according to claim 19, wherein said ribs are fully discrete.

22. The can end according to claim 19, wherein said ribs merge at one or both of their end regions and/or merge at regions part way along their extents, with respect to the tear direction.

23. The can end according to claim 19, wherein said panel has one or more further embossed or debossed ribs extending between said first mentioned ribs in a direction substantially perpendicular to said tear direction.

24. The can end according to claim 23 wherein the height or depth of said further ribs is less than the height or depth of the first mentioned ribs.

25. The can end according to claim 1, wherein said score has a score residual of substantially 0.10 mm along all or a majority of the extent of the at least one rib.

26. The can end according to claim 1, wherein said score has an increased score residual at one or both of a region proximal to a nose of said tab and a region that is a final region to be fractured during panel removal.

27. The can end according to claim 26, wherein said increased score residual has a score residual that is in the region of 0.02 mm greater than the score residual of the remainder of the score.

28. The can end according to claim 1, the can end being of aluminium or steel.

29. A method of manufacturing the can end according to claim 1 and comprising forming the embossed or debossed rib(s) prior to forming said score.

30. The can end according to claim 1, wherein the panel is adapted for folding upon opening about an axis located in the panel near an end of at least one rib proximal the first end.

* * * * *